US007597197B2

(12) United States Patent
Lee

(10) Patent No.: US 7,597,197 B2
(45) Date of Patent: Oct. 6, 2009

(54) STRUCTURE OF THREE-DIMENSIONAL STICKER PACKAGE

(75) Inventor: Shih-Feng Lee, Taipei County (TW)

(73) Assignee: Jeng Tair Label Print Co., Ltd., Taipei County (TW)

( * ) Notice: Subject to any disclaimer, the term of this patent is extended or adjusted under 35 U.S.C. 154(b) by 0 days.

(21) Appl. No.: 12/024,121

(22) Filed: Feb. 1, 2008

(65) Prior Publication Data

US 2009/0194438 A1 Aug. 6, 2009

(51) Int. Cl.
*B65D 73/00* (2006.01)

(52) U.S. Cl. ..... 206/470; 206/471; 206/820

(58) Field of Classification Search ..... 206/460, 206/461, 466, 469, 470, 471, 820; 428/40.1, 428/41.7, 41.8; 40/638
See application file for complete search history.

(56) References Cited

U.S. PATENT DOCUMENTS 3,501,365 A * 3/1970 Marshall ..... 428/42.3
3,869,333 A * 3/1975 McMaster ..... 206/820
4,055,249 A * 10/1977 Kojima ..... 206/460
4,200,193 A * 4/1980 Boyle ..... 206/461
4,505,770 A * 3/1985 Larimore ..... 206/447
5,037,000 A * 8/1991 Selame ..... 206/470
5,512,343 A * 4/1996 Shaw ..... 428/42.1
5,566,826 A * 10/1996 Evans ..... 206/338
6,177,163 B1 * 1/2001 Blok et al. ..... 428/40.1

* cited by examiner

*Primary Examiner*—Luan K Bui
(74) *Attorney, Agent, or Firm*—Leong C. Lei

(57) ABSTRACT

A sticker package includes a sticker assembly and a package case. The sticker assembly includes an elongate strip of flexible film and a continuously extended sticker attached to a surface of the flexible film. The sticker has a projection area on the surface of the flexible film that is smaller than the surface area of the surface of the flexible film. The package case includes upper and lower lids. The upper lid is bulged to form a receiving compartment. The lower lid is cut to form an opening. The sticker assembly is wound up as a roll received and retained in the receiving compartment with a leading end extending out of the case through the opening. To use, the sticker assembly is pulled off the package case through the opening and the sticker is then allowed to peel off the flexible film.

1 Claim, 6 Drawing Sheets

STRUCTURE OF THREE-DIMENSIONAL STICKER PACKAGE

BACKGROUND OF THE INVENTION (a) Technical Field of the Invention

The present invention relates to an improvement of sticker, and in particular to a sticker package that facilitates storage and use of the sticker.

(b) Description of the Prior Art

As shown in FIG. 1 of the attached drawings, a conventional sticker assembly is often formed by attaching a sticker 12 on a release paper II of substantially the same size. After being subjected to cutting operation, a three-dimensional sticker 13 in an elongated form is formed. To use, the sticker 13 is peeled off the release paper II for sticking to a target object, such as a piece of paper or an article. The conventional sticker 13 is made with a preset length so that when it is applied to an area of a greater length, more than one sticker 13 is needed and an obvious discontinuity or interrupt can be observed between adjacent stickers. This looks ugly.

Thus, as shown in FIG. 2, another sticker is proposed, which comprises a release paper 21 and a sticker 22, both being of the identical shape. The release paper 21 with the sticker 22 attached thereto is wound up as a roll and is received in a package case 23 so that the release paper 21 and the sticker 22 can be pulled off the case 23 to allow the sticker 23 to be peeled off the release paper 21 for sticking to a target object. Since the release paper 21 and the sticker 22 are of the same shape and size, peeling the sticker 22 off the release paper 21 is very difficult and may even break the sticker 22.

In view of these problems, the present invention is aimed to provide a sticker package that overcomes the drawbacks of the conventional designs.

SUMMARY OF THE INVENTION

The primary purpose of the present invention is to provide a sticker package that facilitates storage and use of a sticker by easing peeling of the sticker to thereby enhance the practical value of the sticker.

In accordance with the present invention, a sticker package is provided, comprising a sticker assembly and a package case, wherein the sticker assembly comprises an elongate strip of flexible film and a continuously extended sticker attached to a surface of the flexible film. The sticker has a projection area on the surface of the flexible film that is smaller than the surface area of the surface of the flexible film. The package case forms a bulged receiving compartment on one side thereof and an opening in an opposite side. The sticker assembly that is formed by attaching the sticker to the flexible film is received and retained in the receiving compartment of the package case. To use, the sticker assembly is pulled off the package case through the opening and the sticker is then allowed to peel off the flexible film. Thus, the use and storage of the sticker assembly are enhanced and made convenient and efficient.

In accordance with a preferred embodiment of the present invention, the sticker assembly is wound around a core tube to form a roll, which is accommodated in the receiving compartment of the package case.

In accordance with the present invention, the package case comprises upper and lower lids connected to each other. The receiving compartment is formed by making the upper lid outward bulged. The opening is formed by cutting a front portion of the lower lid. The sticker assembly in the form of a roll is interposed and retained between the upper and lower lids.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
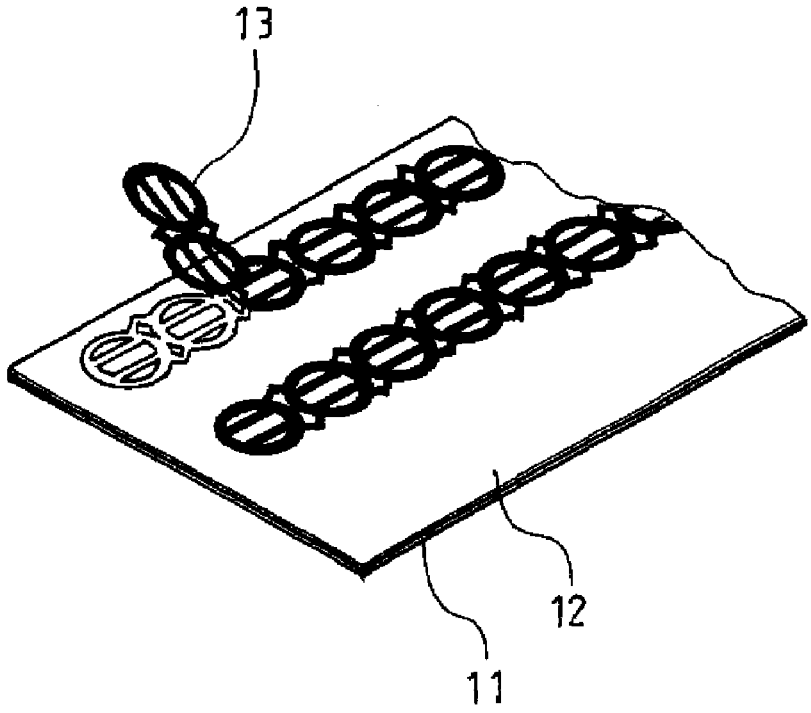
PRIOR ART FIG. 1
FIG. 1 is a perspective view of a conventional sticker.
Figure 2:
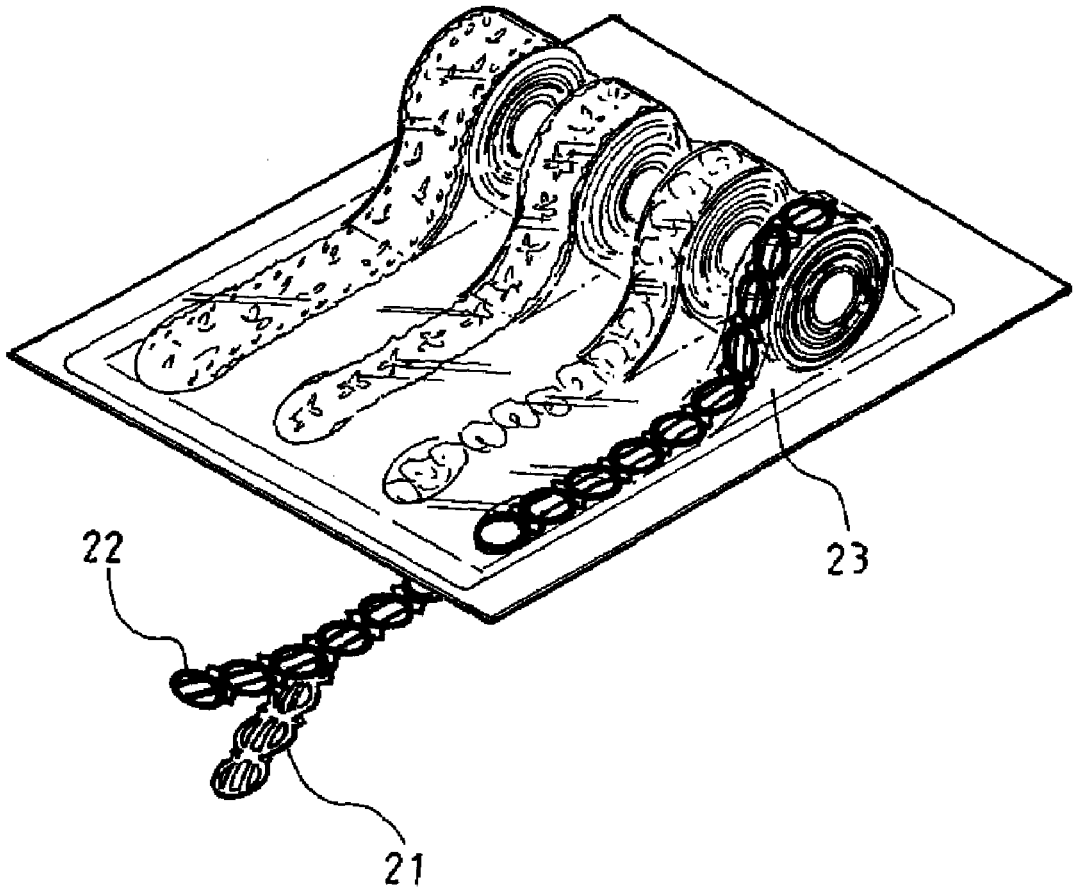
PRIOR ART FIG . 2
FIG. 2 is a perspective view of another conventional sticker.
Figure 3:
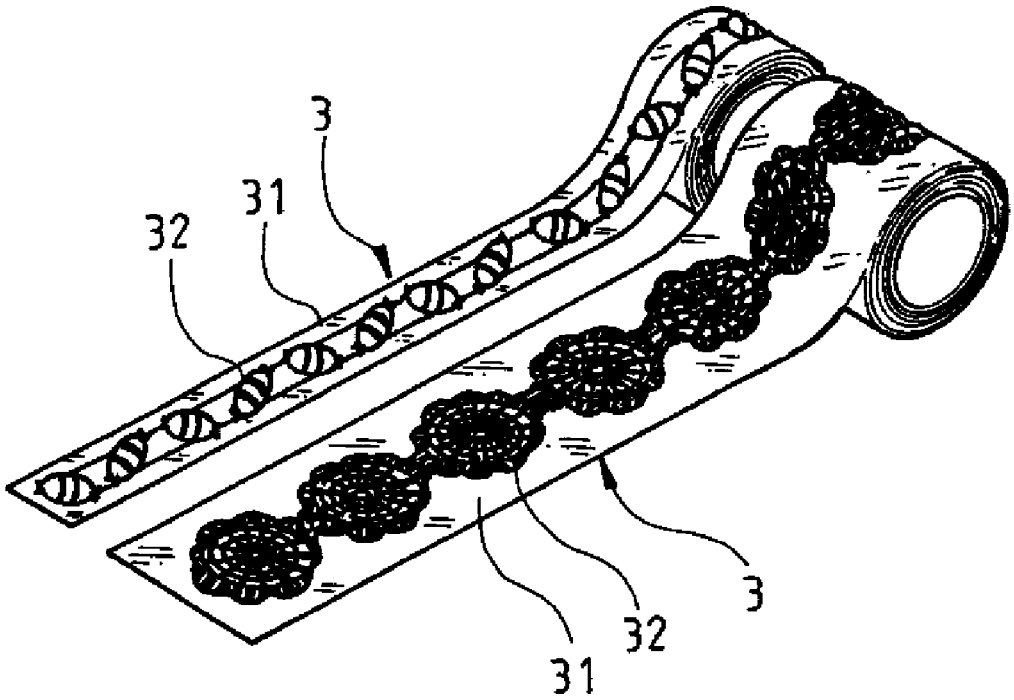
FIG. 3 is a perspective view showing a sticker assembly in accordance with the present invention.
Figure 4:
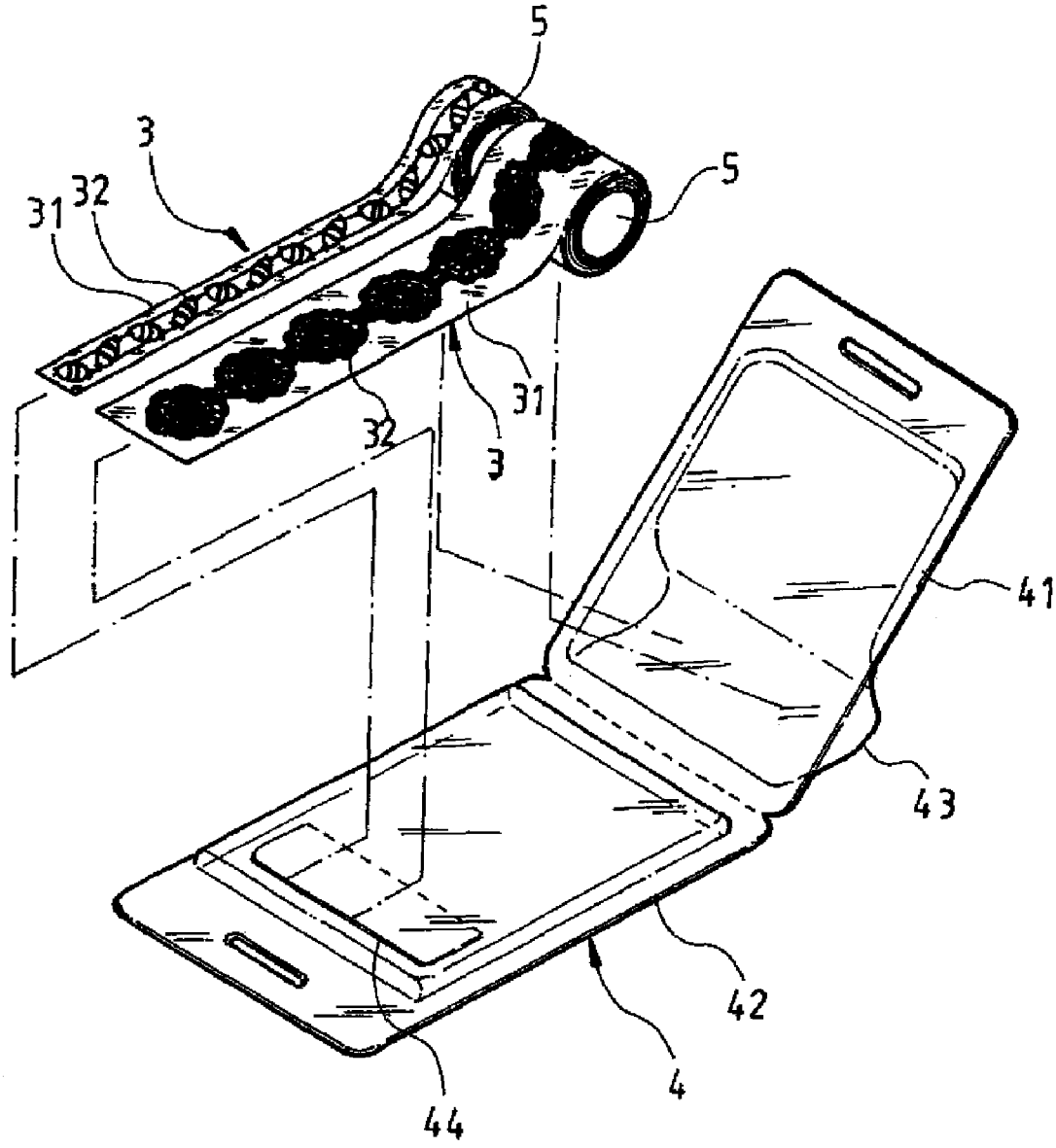
FIG. 4 is an exploded view of a sticker package in accordance with the present invention.

With reference to the drawings and in particular to FIGS. 3 and 4, the present invention provides a sticker package that is comprised of a sticker assembly 3 and a package case 4. The sticker assembly 3 comprises an elongate strip of flexible plastic film 31, which can be for example and as illustrated in the drawings a transparent film, and a three-dimensional sticker 32 attached to the flexible film 31. The flexible film 31 and the sticker 32 are made so that the projection area of the sticker 32 onto the flexible film 31 is less than the surface area of the flexible film 31.

The package case 4 comprises an upper lid 41 and a lower lid 42 that are connected, preferably in a hinged manner, to each other. The upper lid 41 has a rear half or portion that is made raised and thus outward bulged to form a receiving compartment 43. The lower lid 42 has a front portion in which a U-shaped cut is formed to serve as an opening 44.

With the above described constituent components, the sticker assembly 3 that is formed by attaching the sticker 32 to the elongate flexible film 31 is of a substantial length and is wound around a cylindrical core tube 5 to form a roll. The sticker roll is received and retained in the receiving compartment 43 of the package case 4 and interposed between the upper and lower lids 41, 42. A leading end section of the sticker assembly 3 is pulled off the roll in advance to allow the sticker assembly 3 to be easily pulled out through the opening 44 of the lower lid 42 so that the sticker 32 can be peeled off the section of the flexible film 31 is that pulled out of the case 4 for sticking to a target object, such as a piece of paper or an article. This facilitates the retrieval and use of the sticker 32.

Figure 5:
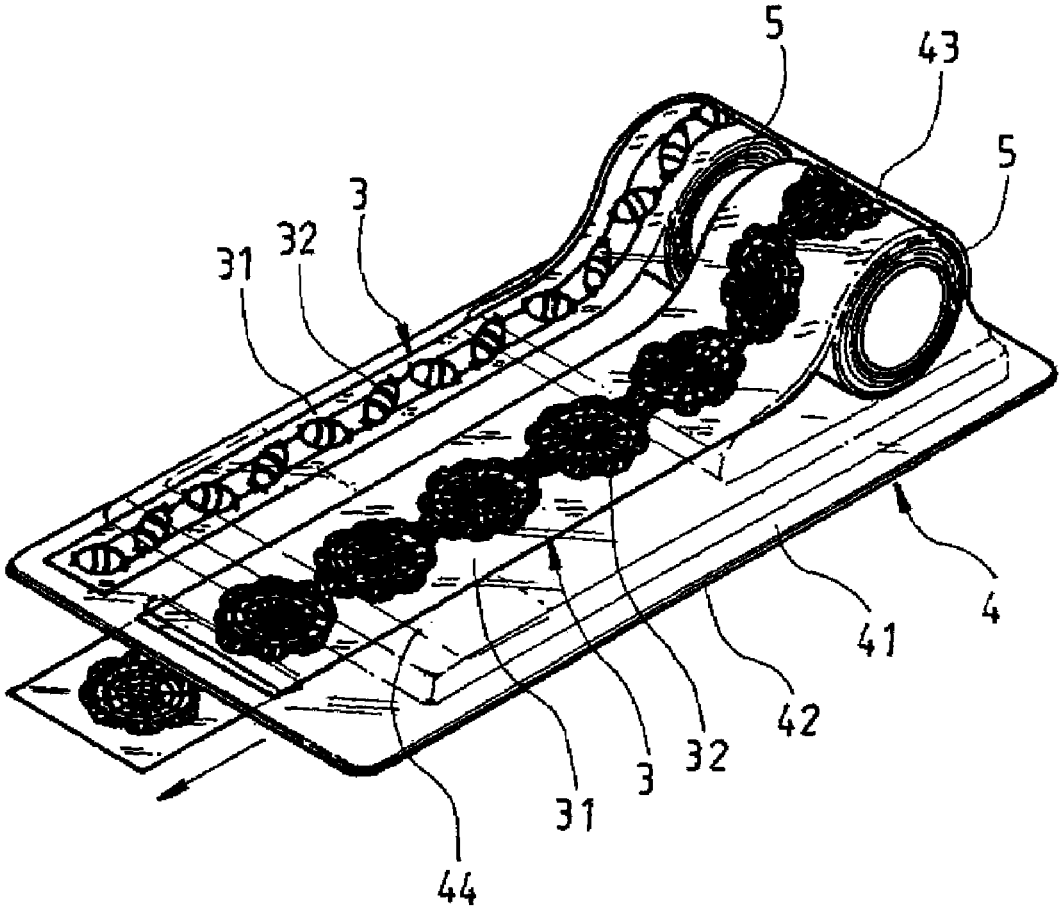
FIG. 5 is a perspective view of the sticker package of the present invention.

Also referring to FIG. 5, in making the sticker assembly, the sticker assembly 3 is first wound around the core tube 5 to form the sticker roll and the sticker roll is put into the receiving compartment 43. A leading end section of the sticker assembly 3 is unwound from the roll and interposed between the upper and lower lids 41, 42 with the leading end tip of the sticker assembly 3 extending outward through the opening 44 of the lower lid 42 to facilitate storage and carrying. To use, the sticker assembly 3 can be continuously and smoothly pulled off the case 4 through the opening 44 of the lower lid 42.

Figure 6:
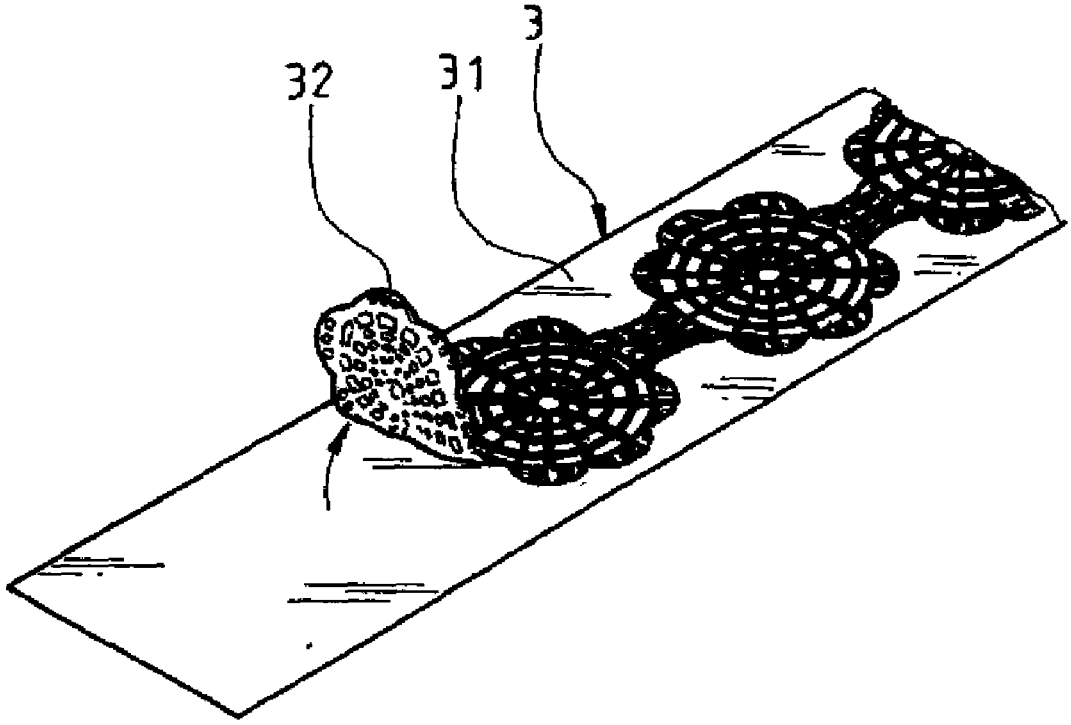
FIG. 6 is a perspective view illustrating a sticker being peeled off a flexible film in accordance with the present invention.

Also referring to FIG. 6, when the sticker assembly 3 is pulled off the case 4 through the opening 44 of the lower lid 42 by a desired length, the sticker 32 can be peeled off the flexible film 31 for sticking to a target, such as a piece of paper or an article. Since the projection area of the sticker 32 is less than the surface area of the flexible film 31, the sticker 32 can be easily peeled off the flexible film 31. Further, since the sticker 32 is packaged in a rolled form, it can be made elongated and continuous, so that the sticker 32 does not show any interruption or discontinuity when applied to a target and aesthetics is enhanced.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sticker package comprising:

a sticker assembly comprising an elongate strip of flexible plastic film and a three-dimensional sticker attached to said flexible film, projection area of said sticker onto said flexible film being less than surface area of said flexible film;

a package case comprising an upper lid and a lower lid hinged to said upper lid, said upper lid having a rear portion that is made raised and thus outward bulged to form a receiving compartment, said lower lid having a front portion in which a U-shaped cut is formed to serve as an opening which allows said sticker assembly to be pulled out of said package case; and a core tube on which is wound said sticker assembly to form a sticker roll, said sticker roll being put into said receiving compartment;

wherein said sticker assembly is arranged inside said package case with a leading end section of said sticker assembly being unwound from said sticker roll in advance to allow for subsequently pulling said sticker assembly off said package case through said opening of said lower lid thereby enabling said sticker to be peeled off said flexible film for sticking to a target object and therefore enabling said sticker to be made elongated and continuous.

* * * * *